United States Patent [19]

Hyner et al.

[11] Patent Number: 4,837,090

[45] **Date of Patent: * Jun. 6, 1989**

[54] CORROSION RESISTANT COATING FOR FASTENERS

[75] Inventors: Jacob Hyner, Waterbury; Steven Gradowski, Torrington, both of Conn.

[73] Assignee: Whyco Chromium Company, Inc., Thomaston, Conn.

[ * ] Notice: The portion of the term of this patent subsequent to May 24, 2005 has been disclaimed.

[21] Appl. No.: 192,480

[22] Filed: May 11, 1988

Related U.S. Application Data

[63] Continuation-in-part of Ser. No. 117,794, May 24, 1988, Pat. No. 4,746,408.

[51] Int. Cl.[4] ..... B32B 15/08

[52] U.S. Cl. ..... 428/626; 428/658; 428/679; 428/680; 411/903

[58] Field of Search ..... 428/626, 658, 657, 679, 428/680, 681; 411/902, 903

[56] References Cited

U.S. PATENT DOCUMENTS

| | | | |
|---|---|---|---|
| 1,564,581 | 12/1925 | King | 428/658 |
| 2,419,231 | 4/1947 | Schantz | 428/658 |
| 2,989,446 | 6/1961 | Hammond et al. | 204/41 |
| 3,420,754 | 1/1969 | Roehl | 204/28 |
| 4,188,459 | 2/1980 | Hyner et al. | 428/658 |
| 4,282,073 | 8/1981 | Hirt et al. | 204/28 |
| 4,314,893 | 2/1982 | Clauss | 204/40 |
| 4,329,402 | 5/1982 | Hyner et al. | 428/658 |
| 4,407,900 | 11/1983 | Kirihara et al. | 428/658 |
| 4,500,610 | 2/1985 | Gunn et al. | 428/658 |
| 4,508,600 | 4/1985 | Irie et al. | 204/27 |
| 4,746,408 | 5/1988 | Hyner et al. | 428/681 |

FOREIGN PATENT DOCUMENTS

| | | |
|---|---|---|
| 57-207199 | 12/1982 | Japan . |
| 8101750 | of 0000 | PCT Int'l Appl. . |

*Primary Examiner*—L. Dewayne Rutledge
*Assistant Examiner*—George Wyszomierski
*Attorney, Agent, or Firm*—DeLio & Associates

[57] ABSTRACT

A corrosion resistant coating and process comprises the following layers applied in sequence over a ferrous metal substrate: a micro-throwing nickel-zinc alloy plating; an optional galvanically protective zinc metal plating; a zinc-nickel alloy plating containing 5 to 30 weight percent nickel; and an organic coating such as paint. The coating is preferably used with steel drill screw fasteners wherein it also reduces installation torque and drill time.

12 Claims, No Drawings

CORROSION RESISTANT COATING FOR FASTENERS

BACKGROUND OF THE INVENTION

This application is a continuation-in-part of Ser. No. 117,794, issued on May 24, 1988 as U.S. Pat. No. 4,746,408.

The present invention relates to multi-layered coatings to impart corrosion resistance to ferrous metal fastener substrates and, in particular, to a combination of metal plating and organic coating layers for such substrates.

In areas where corrosion of ferrous metal substrates provide particular and pervasive problems, it is well known to utilize organic films such as paints and metallic coatings such as metal plating to minimize the effects of corrosion. Prior art in the general area of ferrous metal plating discloses nickel plating over an intermediate nickel zinc alloy plating (75 to 90% zinc), as in U.S. Pat. No. 1,564,581, and the use of zinc-rich, zinc-nickel alloy plating over a layer of copper or nickel plating, as in U.S. Pat. No. 2,419,231. Other uses of zinc-nickel plating layers are found in U.S. Pat. Nos. 4,282,073; 3,420,754; 4,407,900; and 4,314,893, and in Japanese Patent Publication No. 57-207199.

In automotive and other applications where relatively severe corrosive agents are found, and, in particular, for the metal fasteners used in such applications, improvements in corrosion resistance have been disclosed in U.S. Pat. Nos. 4,188,459 and 4,329,402, the disclosures of which are hereby incorporated by reference. Prior to the aforementioned patents, it was known that automotive fasteners can utilize sequential plating layers of copper, cadmium, copper, nickel and chromium or a chromium substitute such as tin-nickel, tin-cobalt or tin-cobalt-zinc alloys.

U.S. Pat. No. 4,188,459 discloses a multi-layered corrosion resistant plating for fasteners comprising a first micro-throwing alloy layer of nickel alloy followed by a layer of a galvanically protective metal or alloy such as cadmium, cadmium-tin, a dual layer of cadmium and tin, zinc or zinc alloy. Over this galvanically protective layer there is applied a layer of copper plating, followed by a layer of nickel plating, followed by a layer of chromium or metallic chromium substitute. U.S. Pat. No. 4,329,402 discloses the same first layer of a micro-throwing alloy, with the galvanically protective plating layer optionally applied next, and followed by an outer layer of chromate film or an organic coating such as paint.

While the aforementioned plating and coating layers provide good protection, it is advantageous to provide comparable or superior protection with a minimum of coating layers, for obvious cost reasons. While the galvanic protective layers of zinc are desirable, when they are utilized as the final plating layer there is often the problem of the production of an insoluble white corrosion product as they are sacrificially attacked by corrosive agents in use.

In the area of automotive fasteners where the fasteners are often applied manually on the assembly line there is additional problems of fatigue of the assembly worker due to the often high installation torques, and long drill times resulting from the use of high friction and thicker corrosion resistant coatings. Cadmium plating has provided lower friction to ferrous fasteners, but such plating has considerable drawbacks with respect to disposal of plating bath effluent containing cadmium metal and the cyanide often used in such baths, as well as the presence of poisonous metallic cadmium on the fastener.

Bearing in mind these and other deficiencies of the prior art, it is therefore an object of the present invention to provide superior corrosion resistant to ferrous metal substrates which are used in relatively severe corrosive environments such as those found in the automobile.

It is another object of the present invention to provide a corrosion resistant coating which is relatively low in cost yet is reliable in application and performance.

It is a further object of the present invention to provide a superior corrosion resisting protection for metal substrates having surface defects such as pits, cracks, laps, or voids.

It is another object of the present invention to provide the aforementioned corrosion resistant properties for ferrous metal fasteners, in particular.

It is a further object of the present invention to provide a corrosion resistant ferrous metal fastener which has a lower installation force or torque.

It is still another object of the present invention to provide improved fastener installation and corrosion resistance without the use of cadmium.

SUMMARY OF THE INVENTION

The above and other objects, which will be obvious to one skilled in the art, are achieved in the present invention which provides, in a first aspect, a process for improving the corrosion resistance of a ferrous metal fastener comprising the steps of applying a layer of nickel or a nickel alloy over the metal fastener and thereafter applying a second layer of a zinc alloy over the nickel or nickel alloy layer. In another aspect, the present invention relates to a ferrous metal fastener having a corrosion resisting multi layer coating applied as described above. In both aspects of the invention it is preferred that the first layer be a micro-throwing nickel alloy with the outer plating layer being a zinc-nickel alloy having from about 5 to about 30 weight percent nickel. Optionally, an organic coating or chromate conversion covers the zinc-nickel alloy layer. Drill screw fasteners coated according to the present invention have been found to have significantly reduced installation torque and drill times.

DETAILED DESCRIPTION OF THE INVENTION

The multiple coating layers of the present invention can be applied to any ferrous metal substrate, e.g., iron or steel, and are particularly advantageous when applied to fasteners such as rivets or drill screws or other metal cutting screws subject to relatively severe corrosive environments. Fasteners used on automobile or truck exteriors fall into this category. Examples of drill screw fasteners are disclosed in U.S. Pat. Nos. 4,692,080; 4,730,970 and 4,713,855, the disclosures of which are hereby incorporated by reference.

The first layer applied to and directly over the ferrous metal fastener substrate is a plating of nickel or nickel alloy such as nickel-zinc, nickel-iron or nickel-cobalt. The preferred first layer is a micro-throwing nickel alloy as described in U.S. Pat. Nos. 4,188,459 and 4,329,402. The micro-throwing alloy is particularly advantageous in that it has the ability to preferentially plate in surface defects of metal substrates such as pits, cracks, laps, or voids as small as 0.00002 inches in size. The micro-throwing alloy deposits and forms a layer which is even thicker inside of the surface defects, seams, pits or the like than on the plane surface from which the surface defect is formed.

The micro-throwing nickel alloy preferably utilizes a second, alloying metal component selected from zinc, iron, cobalt or cadmium. Preferably, the nickel comprises about 97.0 to 99.9% by weight of the alloy, while the zinc or cadmium comprises 0.1 to 3.0 percent by weight. Most preferably, zinc is employed as the alloying agent in an amount less than 1.0% by weight of the alloy, with the nickel comprising the balance. Ternary or quaternary alloy containing nickel and zinc may also be advantageously utilized. The thickness of the first micro-throwing alloy layer is preferably between 0.0005 and 0.00005 inches, more preferably over 0.0001 and up to 0.0004 inches. This layer is not generally considered to be a so-called "strike" layer but is meant to level irregularities on the fastener surface and provide corrosion protection on its own.

The micro-throwing nickel alloy may be applied by conventional electroplating baths and techniques. For example, nickel-cadmium alloys can be electroplated from sulfate or sulfate-chloride type baths as are conventionally known and commercially available. Likewise, nickel-zinc alloys can be plated from chloride, sulfate, sulfamate, ammoniacial or pyrophosphate type baths.

To protect the underlying nickel plating layer and metal substrate, a second layer of a galvanically protective zinc is optionally applied to and directly over the nickel first layer. This second layer, when present, acts as the primary sacrificial anode which corrodes preferentially and protects the underlying metal if and when it is perforated. The property of the micro-throwing alloy to level out or fill any surface defects in the underlying metal substrate acts to remove areas of low current density which provide problems when electroplating this galvanic layer. The preferential galvanic layer is electrodeposited essentially pure zinc which may be plated in a zinc bath commercially available from MacDermid, Inc., Waterbury, Conn. under the trade name "Kenlevel II". The preferred thickness of the galvanic layer is about 0.003 to 0.00010 inches, with a minimum thickness of 0.0005 inches being more preferred.

Although the protection given the underlying metal by an essentially pure zinc galvanic layer is desirable, the corrosion product formed by oxidation of this galvanic layer is not. From both a functional and aesthetic view point, it is advantageous to minimize the formation of this corrosion product which, in the case of zinc, is white, insoluble and may comprise zinc carbonate ($Zn_2CO_3$), zinc oxide (ZnO) and other compounds. To retain the advantages of this galvanic layer while minimizing its disadvantages, the present invention provides in combination a separate layer of a zinc alloy which is applied either to the aforementioned essentially pure zinc layer or directly onto the first nickel or nickel alloy layer. For simplicity of manufacturing and significant cost advantages, it is preferred that this zinc alloy layer is applied directly over and to the first nickel or nickel alloy layer. This separate zinc alloy contains a major amount of zinc but does not as readily form the white corrosion product which results from essentially pure zinc. Additionally, it provides increased life to the ferrous part. Consequently, this zinc alloy layer provides a better appearance and gives additional protection when used over ferrous metal substrates. Suitable alloying elements are nickel, cobalt and iron, with nickel being preferred. The zinc-nickel alloy should contain a major amount of zinc and is preferably from about 70 to 95 weight percent zinc and from about 5 to 30 weight percent nickel, more preferably about 8 to 15 weight percent nickel, balance zinc. Good results have been achieved with 12% nickel.

The zinc-nickel alloy layer is preferably deposited by electroplating directly over the aforementioned layers by conventional and well-known techniques. The thickness of the zinc-nickel alloy layer is preferably about 0.00005 to 0.0007 inches, with a minimum thickness of 0.0001 inches being more preferred. Best results have been found at a thickness of $0.00045 \pm 0.002$ in. for the preferred embodiment where the zinc-nickel alloy layer is deposited directly onto the nickel or nickel alloy layer.

The zinc-nickel layer may be utilized as the outer coating for the steel fastener or other ferrous metal substrate with which it is employed. However, as a preferred final, outer coating directly over the zinc-nickel alloy layer, there may be applied a conversion coating of a chromate or the like or a layer of an organic coating, preferably a paint or metal dye, to provide additional corrosion protection or for aesthetic reasons. Conventional formulations of such coatings and conventional application techniques may be employed, with a substantially continuous film or coating being applied. The thickness of the organic or other coating is not limited and can be varied to obtain the desired level of protection.

The organic coating layer may also include filler material, for example, metal particles, as conventionally employed in metallic paints. The organic coatings which may be utilized include but are not limited to any thermosetting, thermoplastic or nonpolymeric films and preferably may be any conventional paint formulation. Electrophoretic paints such as "E-Coat", available from Man-Gill Chemical Co. of Cleveland, Ohio, are desirable for uniformity of coating. Other paints may be used, such as those having either a thermosetting phenolic resin, or an alkyd, epoxy, melamine or acrylic base. These paints may be applied in any conventional manner including, but not limited to, dipping, spinning, spraying, rolling, brushing or the like. These paints may be either baked or air dried, depending on their formulation and the manufacturer's instructions.

Testing of steel fasteners coated according to the preferred embodiment of the present invention utilizing the intermediate galvanic layer shows salt-spray corrosion resistance essentially equivalent to fasteners utilizing prior art coating of, sequentially, cadmium, copper, nickel and paint layers over a micro-throwing nickel first layer. This excellent corrosion resistance is achieved at considerably lower processing cost than fasteners with the prior art coating.

In addition to the excellent corrosion protection achieved by the multi layer coating of the present invention, when applied to metal fasteners this coating system also provides relatively low friction during installation in conventional steel panels. The preferred coating of the present invention has a torque-tension and installation force which is comparable to that provided by cadmium plating and provides a significant improvement over fasteners having a nickel, chromium aluminium or zinc outer coating. Consequently, lower force is required to set screw-type fasteners into panels and the drill times for setting such fasteners is lower. Testing of steel fasteners plated according to the present invention versus unplated steel fasteners in a standard Illiton Teks test fixture showed that drill times of the former are essentially the same as the latter. Assembly line or other workers, using manual equipment, are therefore subject to less fatigue. These advantages notably are achieved without the use of cadmium in any of the plating layers of the preferred embodiment.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A corrosion resistant fastener having a ferrous metal substrate and, in sequence, the following layers over said substrate:

(a) a first layer of non-strike nickel or a nickel alloy plating of at least 0.00005 in. thickness;

(b) a second layer of zinc-based alloy plating containing from about 8 to 15 weight percent nickel; and (c) a third layer of an organic coating.

2. The fastener of claim 1 wherein said first plating layer (a) is nickel of greater than 0.0001 in. thickness.

3. The fastener of claim 1 wherein said first plating layer (a) is a nickel alloy of greater than 0.0001 in. thickness.

4. The fastener of claim 1 wherein said layers have been produced by electroplating.

5. The fastener of claim 4 wherein layer (a) is a micro-throwing nickel-zinc alloy.

6. The fastener of claim 5 wherein said fastener comprises a drill screw.

7. A corrosion resistant fastener having a ferrous metal substrate and, in sequence, the following layers over said substrate:

(a) a micro-throwing non-strike nickel based alloy plating of at least 0.00005 in. thickness on the substrate;

(b) a zinc based alloy plating containing from about 85 to 92 weight percent zinc and from about 8 to 15 weight percent nickel on the nickel based alloy layer; and (c) an organic coating on the zinc based alloy layer.

8. The fastener of claim 7 wherein said micro-throwing nickel based alloy layer (a) comprises zinc in an amount less than one (1) weight percent.

9. The fastener of claim 8 wherein said fastener comprises a drill screw.

10. A corrosion resistant drill screw fastener having a ferrous metal substrate and, in sequence, the following layers over said substrate:

(a) a micro-throwing nickel based alloy plating containing less that 3 weight percent zinc and of at least 0.00005 in. thickness on the substrate;

(b) a zinc based alloy plating containing from about 85 to 92 weight percent zinc and from about 8 to 15 weight percent nickel on the nickel based alloy layer; and (c) an organic coating of electrophoretic paint on the zinc based alloy layer.

11. The fastener of claim 10 wherein said nickel based alloy layer (a) comprises zinc in an amount less than 1 weight percent.

12. The fastener of claim 10 wherein said nickel based plating layer (a) is greater than 0.0001 in. thickness.

* * * * *